US011651947B2

(12) United States Patent
Wang et al.

(10) Patent No.: US 11,651,947 B2
(45) Date of Patent: May 16, 2023

(54) MASS SPECTROMETER

(71) Applicant: Shimadzu Corporation, Kyoto (JP)

(72) Inventors: Yiming Wang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 103 days.

(21) Appl. No.: 17/337,587

(22) Filed: Jun. 3, 2021

(65) Prior Publication Data

US 2021/0407786 A1 Dec. 30, 2021

(30) Foreign Application Priority Data

Jun. 30, 2020 (CN) ..... 202010616169.5

(51) Int. Cl.

| | |
|---|---|
| ***H01J 49/26*** | (2006.01) |
| ***H01J 49/24*** | (2006.01) |
| ***H01J 49/06*** | (2006.01) |
| ***H01J 49/00*** | (2006.01) |

(52) U.S. Cl.

CPC ..... *H01J 49/26* (2013.01); *H01J 49/0013* (2013.01); *H01J 49/063* (2013.01); *H01J 49/24* (2013.01)

(58) Field of Classification Search

CPC ..... H01J 49/04; H01J 49/0013; H01J 49/24; H01J 49/40; H01J 49/26; H01J 49/063; H01J 49/067; H01J 49/405

See application file for complete search history.

(56) References Cited

U.S. PATENT DOCUMENTS

2016/0049285 A1* 2/2016 Papanastasiou ..... H01J 49/167 250/288
2021/0210329 A1* 7/2021 Carney ..... H01J 49/063

FOREIGN PATENT DOCUMENTS

CN 112243532 A * 1/2021 ..... H01J 49/0009
GB 2483314 B 3/2013
GB 2520785 B 2/2018

* cited by examiner

*Primary Examiner* — David E Smith
*Assistant Examiner* — Hsien C Tsai
(74) *Attorney, Agent, or Firm* — Locke Lord LLP; Tim Tingkang Xia, Esq.

(57) ABSTRACT

A mass spectrometer includes a first vacuum chamber, which is provided with an atmospheric pressure interface communicating with an external atmospheric pressure environment and to a first vacuum pump, the range of working pressure P1 of the first vacuum chamber being P1>30 mbar; a second vacuum chamber, which is connected to the first vacuum chamber by means of a vacuum interface to receive the analyte from the first vacuum chamber and to a second vacuum pump, the range of working pressure P2 of the second vacuum chamber being 0.5 mbar≤P2≤30 mbar; and a third vacuum chamber, which is connected to the second vacuum chamber by means of a vacuum interface to receive the analyte from the second vacuum chamber and to a third vacuum pump, the first vacuum pump or the second vacuum pump being used as a forepump of the third vacuum pump.

10 Claims, 5 Drawing Sheets

MASS SPECTROMETER

CROSS-REFERENCE TO RELATED PATENT APPLICATION

This application claims priority to and the benefit of Chinese Patent Application Serial No. 202010616169.5, filed Jun. 30, 2020, which is incorporated herein in its entirety by reference.

TECHNICAL FIELD

The present invention relates to the technical field of mass spectrometers, in particular to a mass spectrometer capable of balancing performance and miniaturization of the instrument.

BACKGROUND

A mass spectrometer with an atmospheric pressure ionization (API) ion source uses a sample introduction interface communicating with the ion source, such that ions generated at atmospheric pressure (AP) enter a mass analyzer. A traditional mass analyzer usually cannot operate at atmospheric pressure or in a near-atmospheric-pressure condition, and the range of working pressure P of most commercial mass analyzers is P≤0.001 mbar.

As one of the key performances, the sensitivity of the mass spectrometer is closely related to the gas flow entering the system. On one hand, if the ions are directly transferred from an atmospheric pressure environment to a vacuum chamber containing the mass analyzer, it is necessary to make the sample introduction interface very small, which significantly reduces the number of ions transferred to the vacuum chamber, thus limiting the sensitivity of the instrument. On the other hand, because the vacuum chamber containing the mass analyzer works at a relatively low air pressure, according to the equation of Q=SP (wherein Q is the gas flow rate, S is the pumping speed of a pump, and P is the pressure), it is known that a pump with relatively high pumping speed is needed to achieve high flow rate at relatively low pressure, but the vacuum pump with the relatively high pumping speed has a relatively large size accordingly, which is not conducive to miniaturization of the mass spectrometer.

In British patent GB2483314B, company Microsaic disclosed a mass spectrometer with a three-stage vacuum structure, in the latter two stages, two 4800 L/min turbo molecular pumps are used respectively, one diaphragm pump is further needed as the forepump for turbo molecular pump, and another diaphragm pump is needed for pumping the first stage, such that the pump system is relatively complicated and costs high.

In British patent GB2520785B, company WATERS disclosed a compact mass spectrometer with a three-stage vacuum structure, the pressure of the first vacuum stage is less than 10 mbar, and a radio frequency ion guide apparatus is arranged in the first vacuum stage. Because the first vacuum chamber communicates with an external environment, high pumping speed is needed to maintain such pressure range, so that the pump system is hard to be miniaturized.

Therefore, based on the mass spectrometer in the prior art, part of sensitivity will be sacrificed in miniaturization design, or discontinuous sample introduction and other methods are used to accommodate the reduction of the pumping speed of the pump, and it is a challenge to balance all these problems.

SUMMARY

In order to solve the above technical problems, the present invention aims at providing a mass spectrometer which may maintain the inlet gas flow of the system with compact pump system, and therefore guarantees the sensitivity.

The mass spectrometer provided by the present invention includes a first vacuum chamber, which is provided with an atmospheric pressure interface communicating with an external atmospheric pressure environment and is connected to a first vacuum pump, the range of working pressure P1 of the first vacuum chamber being P1>30 mbar; a second vacuum chamber, which is connected to the first vacuum chamber by means of a vacuum interface to receive the analyte from the first vacuum chamber, and is connected to a second vacuum pump, the range of working pressure P2 of the second vacuum chamber being 0.5 mbar≤P2≤30 mbar; and a third vacuum chamber, which is connected to the second vacuum chamber by means of a vacuum interface to receive analyte from the second vacuum chamber, and is connected to a third vacuum pump, the first vacuum pump or the second vacuum pump being used as the forepump of the third vacuum pump.

Since the third vacuum chamber does not directly communicate with the atmospheric pressure environment, but uses the first vacuum chamber and the second vacuum chamber as transition, the pressure of the third vacuum chamber does not or rarely limits the inlet gas flow of the system, and may improve operation stability of some apparatuses with relatively high vacuum requirements, such as mass analyzers.

The first vacuum chamber directly communicates with the atmospheric pressure environment. Compared with the prior art, the first vacuum chamber works in a relatively high pressure range with P1>30 mbar, and in this pressure range, the atmospheric pressure interface may achieve high flow rate of samples or ions by using a roughing pump with low pumping speed. The roughing pump with the low pumping speed can have very small volume, which does not occupy excessive space. As a comparison, if the same flow rate is achieved by increasing the ability of roughing pump of a two-stage vacuum system, the volume increment is far more than the volume of additional low-speed roughing pump mentioned above. Therefore, the mass spectrometer provided by the present invention may achieve a relatively great increment of the inlet gas flow of the system through a relatively few increment of the volume of pump system, such that balance of both miniaturization and high sensitivity becomes possible.

The working pressure P2 of the second vacuum chamber is 0.5 mbar≤P2≤30 mbar, firstly, the working pressure greater than or equal to 0.5 mbar may be achieved by a roughing pump instead of a dedicated turbo molecular pump, it is conducive to miniaturization of the second vacuum pump and reduces the cost. Secondly, the pressure range less than or equal to 30 mbar may provide proper operation conditions for some ion focusing apparatuses, such as a radio frequency focusing apparatus, in the second vacuum chamber, such that even if there is a high pressure difference between the second vacuum chamber and the first vacuum chamber, an ion beam may still be focused and transmitted to the third vacuum chamber, and is not prone to loss due to the expansion caused by pressure difference, with the help of ion focusing apparatus, the influence of gas flow interference on ion transmission is reduced, such that sample introduction to the next vacuum stage is not or less restricted by gas flow, it is conducive to miniaturization of vacuum pump connects to the next vacuum stage.

In the above way, the range of the working pressure P1 of the first vacuum chamber balances the pumping speed of the first vacuum pump and the diameter of the atmospheric pressure interface. On one hand, a roughing pump with relatively low pumping speed and relatively small size could be selected as the first vacuum pump to achieve compact size, and on the other hand, an atmospheric pressure interface with relatively high flow rate may be used for improving the sensitivity of the mass spectrometer. At the same time, the working pressure of the second vacuum chamber may also be achieved by utilizing a roughing pump instead of a turbo molecular pump, thus, the design of pump system could be simplified, which benefits for the miniaturization of the mass spectrometer.

In a preferred technical solution of the present invention, the first vacuum pump and the second vacuum pump are both roughing pumps. The choice of roughing pumps may effectively reduce the size of the first and second vacuum pump.

In the preferred technical solution of the present invention, the pumping speed S1 of the first vacuum pump is one of the following ranges: S1≤1 L/min or S1≤2 L/min or S1≤3 L/min or S1≤4 L/min or S1≤5 L/min. It should be noted that, in this specification, the pumping speeds S1 and S2 refer to maximum pumping speeds that corresponding vacuum pump products can reach, for example, nominal pumping speed of the vacuum pump, which related to the size of the vacuum pump.

In this technical solution, since the working pressure of the first vacuum chamber is relatively high, a roughing pump with low pumping speed can still achieve relatively high gas flow rate. Since the pumping speed S1 of the first vacuum pump is relatively low, a roughing pump with a relatively small size can be selected, thus realizing miniaturization of the pump system of the mass spectrometer.

In the preferred technical solution of the present invention, the pumping speed S2 of the second vacuum pump is one of the following ranges: S2≤10 L/min or S2≤20 L/min or S2≤30 L/min or S2≤40 L/min or S2≤50 L/min.

In this technical solution, the working pressure of the second vacuum chamber is also relatively high, therefore, a roughing pump with relatively small size could also be selected as the second vacuum pump, compared to turbo molecular pump used in second vacuum chamber in prior art, roughing pump is simpler and costs less.

In the preferred technical solution of the present invention, an electrostatic focusing device or an aerodynamic focusing device is arranged in the first vacuum chamber, and is used for focusing ions in first vacuum stage.

Since the electrostatic focusing unit or the aerodynamic focusing unit is arranged in the first vacuum chamber, the ions are focused in a transmission process in the first vacuum chamber, so even if the gas flow expands due to pressure change, the ion beam can still be focused and transmitted in an axial direction, such that a vacuum interface with a relatively small inner diameter may be selected to reduce the gas flow entering the second vacuum chamber, and the loss of ions caused by reduction of interface diameter may be compensated by the means of focusing. Therefore, a roughing pump with relatively low pumping speed may still be used for meeting requirements of pressure and flux of the second vacuum chamber, thus facilitating the miniaturization of the pump system and the mass spectrometer. In addition, the pressure range of the first vacuum chamber provides a stable condition for the electrostatic focusing device or the aerodynamic focusing device.

In the preferred technical solution of the invention, a radio frequency ion guide apparatus is arranged in the second vacuum chamber. The pressure range in the second vacuum chamber guarantees normal operation of the radio frequency ion guide apparatus, and in addition, the radio frequency ion guide apparatus may restrict the ions along ion transmission path, thereby reducing its loss in the transmission process.

In the preferred technical solution of the present invention, the atmospheric pressure interface is a capillary, a cylindrical aperture or a conical aperture. The capillary, the cylindrical aperture or the conical aperture as the atmospheric pressure interface may continuously introduce sample gas carrying ions from the external atmospheric pressure environment, and limit the gas flow rate to a reasonable range by its inner diameter.

In the preferred technical solution of the present invention, the vacuum interface is a cylindrical aperture, a conical aperture or a combination thereof. By using the cylindrical aperture and the conical aperture as the vacuum interface, the gas flow entering the next vacuum chamber may be limited; and the stable transmission of the ion beam may be kept through the aperture.

In the preferred technical solution of the present invention, the third vacuum pump is a turbo molecular pump, and the mass analyzer is arranged in the third vacuum chamber. The compact air-cooling turbo molecular pump could reach relatively low pressure, and could be installed in any direction. A small-sized or medium-sized turbo molecular pump may tolerate a relatively high pre-pumping pressure, so the roughing pump may be used as the forepump, and the combination of roughing pump and the turbo molecular pump provides a suitable pressure range for the mass analyzer.

In the preferred technical solution of the present invention, the mass analyzer is a quadrupole mass analyzer or an ion trap mass analyzer. The quadrupole mass analyzer or the ion trap mass analyzer has a small size and may work normally in a relatively high pressure.

Figure 1:
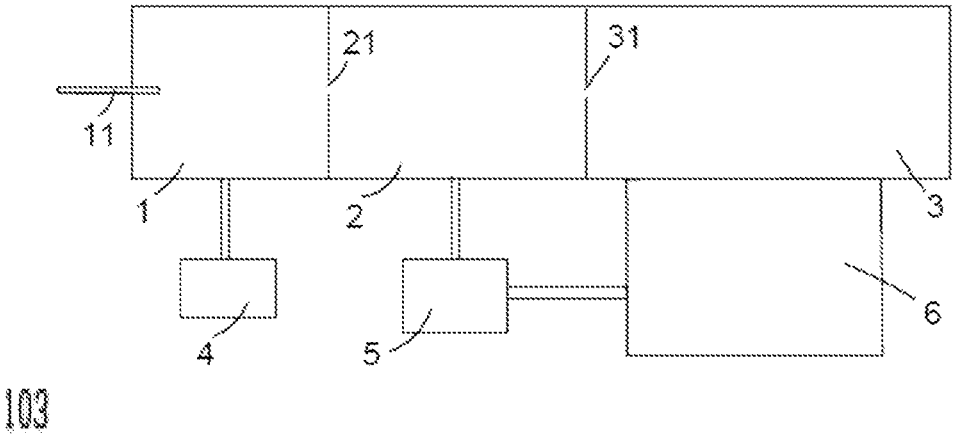
FIG. 1 is a structural schematic diagram of part of a mass spectrometer in embodiment 1 of the present invention.

Description of Reference Numerals:

1—first vacuum chamber; 11—atmospheric pressure interface; 12—ion focusing device; 2—second vacuum chamber; 21—vacuum interface; 22—radio frequency ion guide apparatus; 3—third vacuum chamber; 31—vacuum interface; 32—mass analyzer; 4—first vacuum pump; 5—second vacuum pump; 6—third vacuum pump; 7—ion detector; and 8—ion source.

DETAILED DESCRIPTION OF THE EMBODIMENTS

Hereinafter, exemplary embodiments will be described in detail with reference to the accompanying drawings. However, the present invention is not limited to the following embodiments, but includes various changes, substitutions and modifications within the technical scope of the present disclosure.

Embodiment 1

Sensitivity of a mass spectrometer is closely related to the gas flow entering the system, and the gas flow rate depends on the working pressure of the vacuum chamber and the pumping speed of vacuum pump. Take the first vacuum chamber 1 as an example, when the pumping speed of the first vacuum pump 4 is relatively high, the inner diameter of the atmospheric pressure interface 11 could be relatively large, such that the number of ions passing through the aperture is relatively large, thereby improving the sensitivity of the mass spectrometer. On the other hand, the pumping speed of the vacuum pump is closely related to its size, when the pumping speed of the vacuum pump is relatively high, its size may increase accordingly, which is not conducive to miniaturization of the mass spectrometer. Therefore, this embodiment aims at providing a mass spectrometer capable of balancing the sensitivity and miniaturization of the instrument.

As shown in FIG. 1, the mass spectrometer provided by this embodiment includes the first vacuum chamber 1, which is provided with the atmospheric pressure interface 11 communicating with an external atmospheric pressure environment and is connected to the first vacuum pump 4, the range of working pressure P1 of the first vacuum chamber 1 being P1>30 mbar; a second vacuum chamber 2, which is connected to the first vacuum chamber 1 by means of a vacuum interface 21 to receive the analyte from the first vacuum chamber 1, and is connected to a second vacuum pump 5, the range of working pressure P2 of the second vacuum chamber 2 being 0.5 mbar≤P2≤30 mbar; and a third vacuum chamber 3, which is connected to the second vacuum chamber 2 by means of a vacuum interface 31 to receive the analyte from the second vacuum chamber 2, and is connected to a third vacuum pump 6, the first vacuum pump 4 or the second vacuum pump 5 being used as the forepump of the third vacuum pump 6.

In this embodiment, since the third vacuum chamber 3 does not directly communicate with the atmospheric pressure environment, but uses the first vacuum chamber 1 and the second vacuum chamber 2 as transition, the relatively low pressure of the third vacuum chamber 3 does not or rarely limits the inlet gas flow of the system, and provides suitable working condition for some apparatuses with high vacuum requirements, such as mass analyzers.

The pressure of the first vacuum chamber 1 is configured in a relatively-high range with P1>30 mbar, and in this pressure range, the atmospheric pressure interface 11 may achieve high flow rate of samples or ions by using a roughing pump with low pumping speed, such that balance of both miniaturization and high sensitivity becomes possible.

The working pressure P2 of the second vacuum chamber 2 is 0.5 mbar≤P2≤30 mbar, firstly, the working pressure greater than or equal to 0.5 mbar may be achieved by a roughing pump instead of a dedicated turbo molecular pump, it is conducive to miniaturization of the second vacuum pump 5 and reduces the cost. Secondly, the pressure range less than or equal to 30 mbar may provide proper operation conditions for some ion focusing apparatuses, such as a radio frequency focusing apparatus, in the second vacuum chamber 2, such that even if there is a high pressure difference between the second vacuum chamber 2 and the first vacuum chamber 1, an ion beam may still be focused and transmitted to the third vacuum chamber 3, and is not prone to loss due to the expansion caused by pressure difference, with the help of ion focusing apparatus, the influence of gas flow interference on ion transmission is reduced, such that sample introduction to the next vacuum stage is not or less restricted by gas flow, it is conducive to miniaturization of a vacuum pump connects to the next vacuum stage.

In the above way, the range of the working pressure P1 of the first vacuum chamber 1 balances the pumping speed of the first vacuum pump 4 and the diameter of the atmospheric pressure interface 11. On one hand, a roughing pump with relatively low pumping speed and relatively small size could be selected as the first vacuum pump 4 to achieve compact size, and on the other hand, an atmospheric pressure interface 11 with relatively high flow rate may be used for improving the sensitivity of the mass spectrometer. At the same time, the working pressure of the second vacuum chamber 2 may also be achieved by utilizing a roughing pump instead of a turbo molecular pump, thus, the design of pump system could be simplified, which benefits for the miniaturization of the mass spectrometer.

In some embodiments, the working pressure of the first vacuum chamber 1 is further preferably 50 mbar≤P1≤70 mbar, and the working pressure of the second vacuum chamber 2 is further preferably 3.0 mbar≤P2≤6.0 mbar. By further arranging the first vacuum chamber 1 and the second vacuum chamber 2 in the above-mentioned pressure range, the requirements of inlet gas flow rate of the system and the pressure conditions of each vacuum chamber can be effectively balanced, thus obtaining relatively high sensitivity of the system. It should be noted that FIG. 1 only shows a necessary structure of the mass spectrometer that may achieve the technical effect of this preferred embodiment, and does not define other structures.

Embodiment 2

Figure 2:
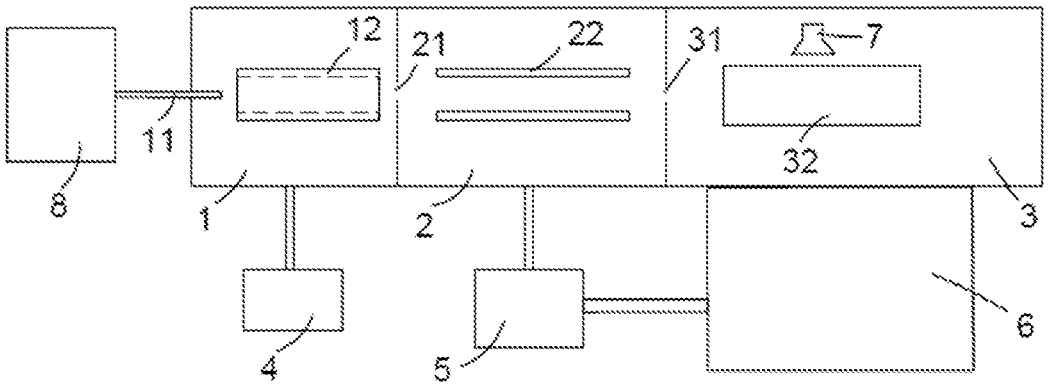
FIG. 2 is a structural schematic diagram of a mass spectrometer in embodiment 2 of the present invention.

As shown in FIG. 2, this embodiment provides a mass spectrometer, and unless otherwise specified, all structures and reference numerals are the same as those of embodiment 1, and are not repeated herein.

An atmospheric pressure interface 11 of the mass spectrometer may be a sample introduction interface or a capillary, the sample introduction interface may be a cylindrical aperture or a conical aperture, and the atmospheric pressure interface 11 in the form of the capillary is taken as an example for illustration in FIG. 2.

A vacuum interface 21 and a vacuum interface 31 may be conical apertures, cylindrical apertures or a combination thereof.

The range of working pressure P1 of the first vacuum chamber 1 is P1>30 mbar, the range of pumping speed S1 of the first vacuum pump 4 is S1≤2 L/min, and since the working pressure of the first vacuum chamber 1 is relatively high, a roughing pump with low pumping speed could still achieve relatively high inlet gas flow rate. Since the pumping speed S1 of the first vacuum pump 4 is relatively low, a roughing pump with a relatively small size can be selected, thus realizing miniaturization of the pump system of the mass spectrometer. For example, a miniature floating scroll pump with a weight less than 0.3 kg and power less than 10 W may be selected, which has a relatively small size, light weight, low power consumption and low noise.

Preferably, the mass spectrometer may further be provided with a chromatographic separation apparatus (not shown in the figure) upstream of the ion source. The chromatographic separation apparatus could be liquid phase or gas phase, and specifically, the separation apparatus could be a capillary electrophoresis (CE) separation apparatus, a capillary electron chromatography (CEC) separation apparatus, a ceramic-based multilayer microfluidic substrate separation apparatus, or a supercritical fluid chromatography separation apparatus.

In this embodiment, the mass spectrometer further includes an ion source 8, the ion source in the form of an API ion source is taken as an example, the range of the inner diameter of the atmospheric pressure interface 11 is 0.1 mm≤d≤0.4 mm, and the range of the gas flow rate Q of the atmospheric pressure interface is Q>150 mL/min. Compared with the gas flow rate in the prior art, sensitivity of the mass spectrometer provided in this embodiment could be higher due to a higher gas flow rate of the atmospheric pressure interface 11 while other configurations are equal.

Preferably, the ion source 8 may further include one or more kinds of electrospray ionization (ESI), microjet ionization, nanospray ionization, chemical ionization (CI), matrix-assisted laser desorption ionization (MALDI), atmospheric pressure photoionization (APPI), and glow discharge ionization.

In this embodiment, the range of working pressure P2 of the second vacuum chamber 2 is designed to be 0.5 mbar≤P2≤30 mbar, and the range of pumping speed S2 of the second vacuum pump 5 is set at S2≤20 L/min.

Compared with the prior art, for example, a mass spectrometer provided by the patent GB2520785, it also has three-stage vacuum chambers like this embodiment, the pressure range of the second vacuum chamber is 0.001-0.1 mbar, a turbo molecular pump with a pumping speed S≤4200 L/min is selected, since the range of the working pressure P2 of the second vacuum chamber 2 in this embodiment may be realized by a roughing pump, the pumping speed S2 of the second vacuum pump 5 is S2≤20 L/min, specifically, the second vacuum pump 5 could be a miniature floating scroll pump with a weight about 2 kg and power less than 80 W, and compared with a turbo molecular pump, the pump system is simpler and costs lower.

In this embodiment, the range of working pressure P3 of a third vacuum chamber 1 is not significantly different from that of the prior art. Generally, the range of the pressure is set at P3≤0.001 mbar, and the third vacuum pump 6 is a turbo molecular pump.

Since the turbo molecular pump (a high vacuum pump) cannot directly connects to atmospheric pressure, a forepump is required for providing a pre-pumping pressure for the turbo molecular pump. Preferably, in this embodiment, the first vacuum pump 4 or the second vacuum pump 5 is selected as the forepump of the third vacuum pump 6. With this arrangement, the pre-pumping pressure is provided using an existing vacuum pump rather than an additional forepump for the third vacuum pump 6, which effectively utilizes the existing pump system, and realizes minimization of the aperture pump system. In addition, although an example of only using the second vacuum pump 5 as the forepump of the third vacuum pump 6 is given in FIG. 2, it is easily conceivable for those skilled in the art to realize that both the first vacuum pump 4 and the second vacuum pump 5 could be selected as the forepump for the third vacuum pump 6, since the first vacuum pump 4 and the second vacuum pump 5 in this embodiment are both roughing pumps. Preferably, the second vacuum pump 5 is connected to the third vacuum pump 6, and through such arrangement, the pre-pumping pressure provided is lower accordingly since the pumping speed of the second vacuum pump 5 is relatively high, such that it is easier for the third vacuum chamber 3 to achieve working pressure.

It should be noted that, in addition to floating scroll pumps, the first vacuum pump 4 and the second vacuum pump 5 may select other vacuum pumps that could achieve the working pressure required by the vacuum chamber, such as a diaphragm pump.

In this embodiment, through design of the working pressure of the first vacuum chamber 1, balance between the vacuum pump size and the diameter of atmospheric pressure interface is realized, such that the working pressure may be realized by a miniature vacuum pump, while the inner diameter of the atmospheric pressure interface 11 is relatively large. Compared with a traditional commercial mass spectrometer, such as Shimadzu LCMS-2020, reduction of inlet gas flow rate of the system is less than one order of magnitude, thus guaranteeing the sensitivity of the instrument.

Compared with the prior art, the miniaturization of the second vacuum pump 5 is realized by optimizing the working pressure of the second vacuum chamber 2 and selecting the second vacuum pump 5.

Reasonable and full utilization of the pump system is realized by using the first vacuum pump 4 or the second vacuum pump 5 as the forepump of the third vacuum pump 6.

To sum up, the mass spectrometer provided in this embodiment realizes miniaturization design of the mass spectrometer while guaranteeing sensitivity of the mass spectrometer by optimizing the working pressure of each vacuum stage with the configuration of pump system.

Preferably, an ion focusing device 12 is arranged in the first vacuum chamber 1 and is used for constraining the trajectory of ions, such that the ions may smoothly enter the next-stage vacuum chamber. Specifically, the ion focusing unit 12 is an electrostatic focusing unit or an aerodynamic focusing unit. Since the pressure range of the first vacuum chamber 1 is relatively high, the radio frequency ion guide apparatus cannot work properly under this condition with working pressure P>30 mbar, thus, the first vacuum chamber 1 selects the electrostatic focusing device or the aerodynamic focusing device to constrain ion trajectory.

Since the electrostatic focusing unit or the aerodynamic focusing unit is arranged in the first vacuum chamber 1, the ions are focused in a transmission process in the first vacuum chamber 1, so even if the gas flow expands due to pressure change, an ion beam may still be focused and transmitted in an axial direction, such that a vacuum interface with a relatively small aperture diameter may be selected to reduce the gas flow entering the second vacuum chamber, and a loss of the ions caused by reduction of the interface diameter may be compensated to a certain extent in virtue of focusing. Therefore, since the required gas flow entering the second vacuum chamber is reduced, a roughing pump with relatively low pumping speed may still be used, thus facilitating the miniaturization of the pump system and the mass spectrometer. In addition, the pressure range of the first vacuum chamber is suitable for the electrostatic focusing device or the aerodynamic focusing device by vacuumizing with a roughing pump.

Preferably, the second vacuum chamber 2 is provided with a radio frequency ion guide apparatus 22 inside for guiding the ions into the next-stage vacuum chamber. The pressure range in the second vacuum chamber 2 is suitable for the radio frequency ion guide apparatus 22, and in addition, the radio frequency ion guide apparatus 22 could constrain the ions along transmission path, thereby reducing the loss of ions in transmission process.

Preferably, the mass spectrometer may further be provided with a chromatographic separation apparatus upstream of the ion source. The chromatographic separation apparatus could be liquid phase or gas phase, the separation apparatus could be a capillary electrophoresis (CE) separation apparatus, a capillary electron chromatography (CEC) separation apparatus, a ceramic-based multilayer microfluidic substrate separation apparatus, or a supercritical fluid chromatography separation apparatus.

Preferably, the atmospheric pressure interface 11 is a capillary, a cylindrical aperture or a conical aperture.

The capillary, the cylindrical aperture or the conical aperture as the atmospheric pressure interface 11 may continuously introduce sample gas carrying ions from the external atmospheric pressure environment, and limit the gas flow rate to a reasonable range by its inner diameter.

Preferably, the vacuum interface is the cylindrical aperture, the conical aperture or a combination thereof. Further preferably, the diameter range of the vacuum interface 31 is 0.2 mm≤d≤0.6 mm.

By using the cylindrical aperture and the conical aperture as the vacuum interface, the gas flow entering the next vacuum chamber may be limited, and the stable transmission of the ion beam may be kept through the aperture.

Preferably, a mass analyzer 32 is arranged in the third vacuum chamber 3 and is used for screening ion samples according to mass-to-charge ratio, and specifically, the mass analyzer 32 is a quadrupole mass analyzer or an ion trap mass analyzer.

The compact air-cooling turbo molecular pump could reach relatively low pressure, and could be mounted in any direction. A small-sized or medium-sized turbo molecular pump may tolerate a relatively high pre-pumping pressure, so the roughing pump may be used as a forepump, and the combination of roughing pump and turbo molecular pump provides a suitable pressure range for the mass analyzer.

The quadrupole mass analyzer or the ion trap mass analyzer has a small size and may work normally in a relatively high pressure range.

Preferably, the mass spectrometer further includes an ion detector 7 corresponding to an ion outlet of the mass analyzer 32.

Preferably, the length range of the ion focusing unit 12 is L≤10 mm;

preferably, the length range of the radio frequency ion guide device 22 is L≤50 mm;

Preferably, the mass analyzer 32 in the form of linear ion trap is taken as an example, and the internal volume of the first vacuum chamber 1 is V≤100 $cm^3$;

The internal volume of the second vacuum chamber 2 is V≤200 $cm^3$; and

The internal volume of the third vacuum chamber 3 is V≤700 $cm^3$.

Total internal volumes of the first vacuum chamber, the second vacuum chamber and the third vacuum chamber preferably are V≤1000 $cm^3$. According to a particularly preferred embodiment, combined internal volumes of the first vacuum chamber, the second vacuum chamber and the third vacuum chamber are about 770 $cm^3$. Compared with a full-size quadrupole mass spectrometer which usually has a total internal volume about 4000 $cm^2$, the total internal volume of the vacuum chamber of the mass spectrometer provided by this embodiment is smaller, further realizing the miniaturization of the mass spectrometer.

It should be noted that although this embodiment gives an example of arrangement of the three-stage vacuum chambers, this is not a limitation to the present invention. Based on this embodiment, those skilled in the art may conceive of arranging more stages of vacuum chambers, such as four-stage vacuum chambers, and accordingly adjusting the working pressure of each vacuum chamber, so as to realize miniaturization of the mass spectrometer.

Further Description of the Technical Effects

Figure 3:
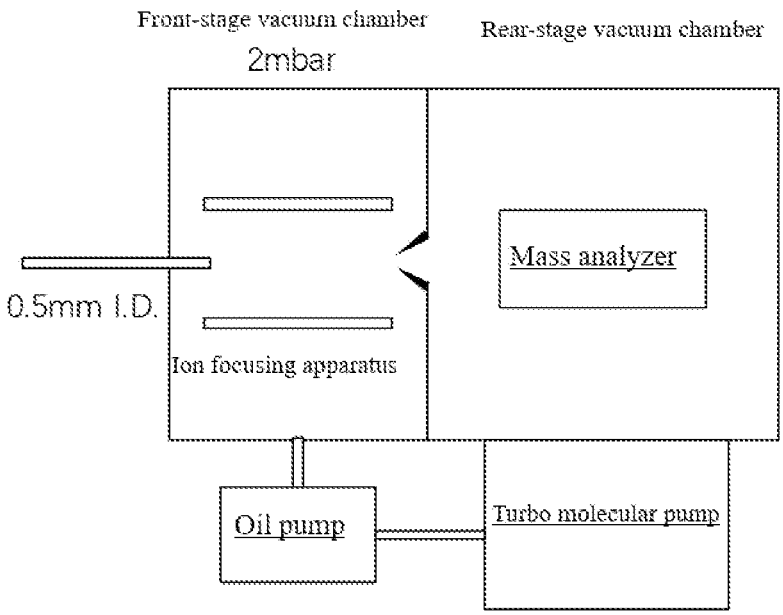
FIG. 3 is a structural schematic diagram of a vacuum system of a normal-sized mass spectrometer in the prior art.

As described in the background art, FIG. 3 is the vacuum system used by a normal-sized mass spectrometer in the prior art, the vacuum system of the mass spectrometer uses a two-stage structure, in which an ion focusing apparatus is arranged in a front-stage vacuum chamber and a mass analyzer is arranged in a rear-stage vacuum chamber.

Some radio frequency ion focusing apparatuses may work stably at a pressure of several mbar. Once the pressure rises to 10 mbar or above, the ion transmission efficiency of these ion focusing apparatuses will be significantly reduced, such that the ion focusing apparatuses will not work stably. In addition, increase of the pressure in the front-stage vacuum chamber may accordingly increase the pressure in the rear-stage vacuum chamber, which affects normal operation of the mass analyzer.

Therefore, setting of vacuum conditions of a multi-stage vacuum system and selection of suitable vacuum device are a systematic project that needs comprehensive consideration.

It is feasible for the normal-sized mass spectrometer to use large-size and high-pumping-speed vacuum pump to guarantee both inlet gas flow rate and pressure requirements of the system because there's no requirement on pump size. For example, an oil pump with a very great pumping speed (400 L/min or above) may be used for the front-stage vacuum chamber, and a vacuum interface with large inner diameter (for example, up to 0.5 mm) may be used to guarantee the gas flow rate of the system. Some normal-sized mass spectrometers using the vacuum system in this structure may achieve an gas flow rate of 1 L/min under the condition that an air pressure of the front-stage vacuum chamber is 2 mbar.

Figure 4:
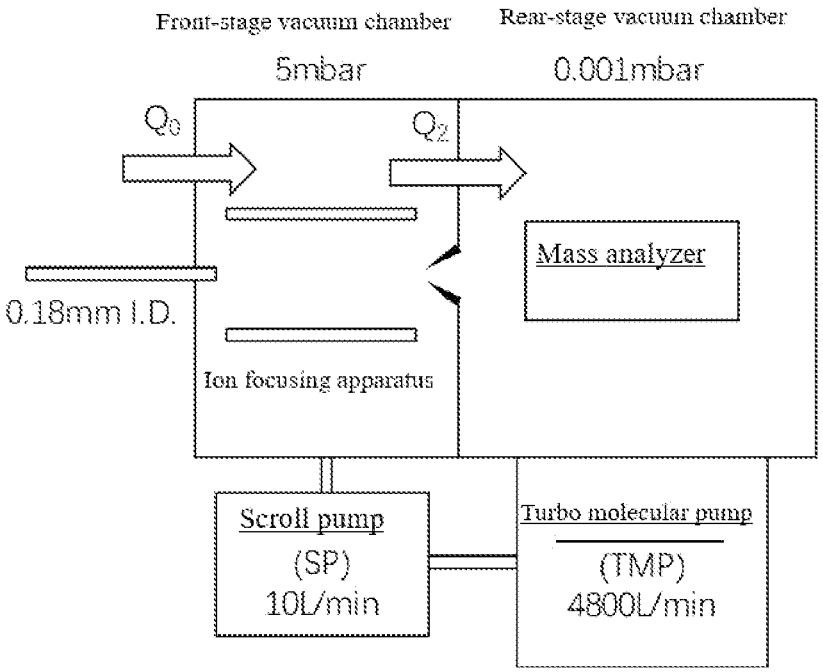
FIG. 4 is a structural schematic diagram of a vacuum system of a compact mass spectrometer in the prior art.

But if the system is to be miniaturized, it is necessary to miniaturize the pump first. There is no doubt that the pump of the front-stage vacuum chamber cannot use a large-size oil pump any longer. FIG. 4 is a structural schematic diagram of a vacuum system of a compact mass spectrometer in the prior art. With reference to FIG. 4, even if a compact vacuum pump which is relatively preferable in terms of pumping speed, ultimate pressure and noise in the market at present is used, and the air pressure of the front-stage vacuum chamber is raised to 5 mbar, calculation is performed according to the following:

The flow rate $Q_2$ of the rear-stage vacuum chamber=the flow rate $Q_{TMP}$ of the turbo molecular pump=0.001 mbar×4800 L/min≈5 mbar·L/min the flow rate $Q_{SP}$ of a scroll pump=5 mbar×10 L/min=50 mbar·L/min $Q_0=Q_2+Q_{SP}$=55 mbar·L/min the inlet gas flow rate $Q_V$ of the system=$Q_0$/atm=0.055 L/min It can be seen that the inlet gas flow rate of the system is still only 55 mL/min. Such flow rate of the system may limit the sensitivity of the system. However, if the pressure of the front-stage vacuum chamber is further increased, there will be fewer types of apparatuses applicable to the front-stage vacuum chamber. For example, some radio frequency ion focusing apparatuses will not work normally under a relatively high pressure.

Figure 5:
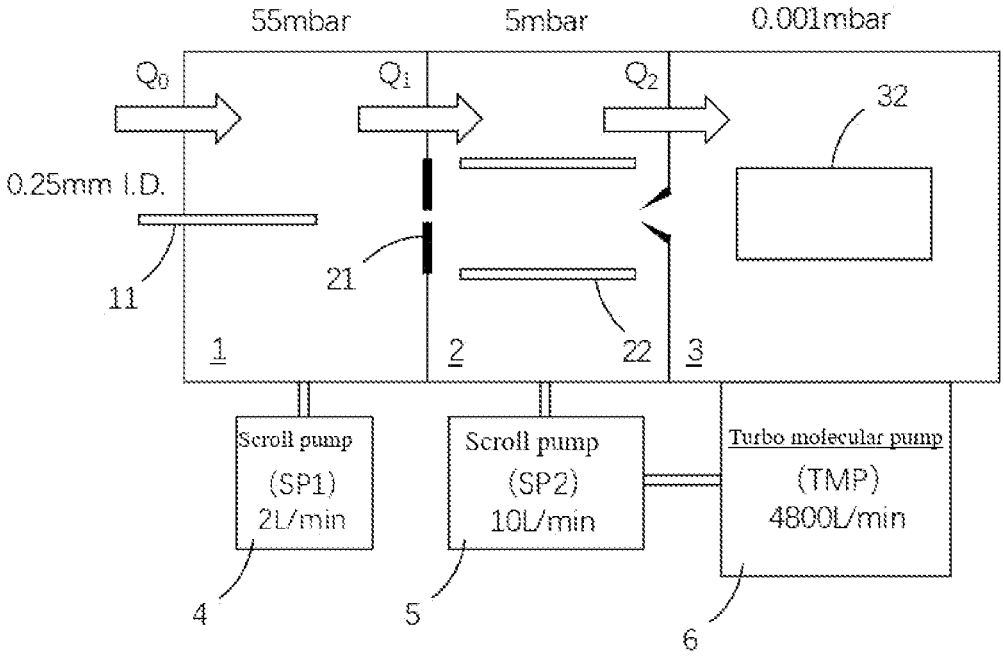
FIG. 5 is a structural schematic diagram of a vacuum system of a mass spectrometer in an embodiment of the present invention.

According to a technical solution provided by the present invention, with the solution shown in FIG. 5 as an example, by adding one or more stages of vacuum chambers ahead, the second vacuum chamber 2 where the ion focusing apparatus (the radio frequency ion guide apparatus 22) is located does not directly communicate with an external environment. The vacuum system in FIG. 5 may improve the gas flow rate of the system to a great extent (for example, twice or higher) while slightly increasing the size of pump system (for example, only one roughing pump with a very small size is added, the increment of volume is negligible to the pump system).

In addition, if the first vacuum chamber 1 is further internally provided with an ion focusing apparatus, the loss of gas flow in transmission process will not be equal to the loss of ions, such that increase of the inlet gas flow rate of the system may increase the number of ions entering the mass analyzer 32 proportionally or greatly, thus effectively balancing miniaturization and sensitivity requirements of a mass spectrometer system.

In combination with a particular calculation result, the technical effects that may be achieved by the vacuum system of the mass spectrometer in some embodiments of the present invention are described below, for example, the technical effect of significant increase of the inlet gas flow rate of the mass spectrometer system with slight increase of the size of the pump system.

With further reference to FIG. 5, the first vacuum chamber 1 communicates with the external atmospheric environment, and a capillary with an inner diameter of 0.25 mm is used as the atmospheric pressure interface 11 for sample introduction, and the working pressure of the first vacuum chamber 1 is 55 mbar. The second vacuum chamber 2 communicates with the first vacuum chamber 1 by using a cylindrical aperture or a conical aperture as a vacuum interface 21, the working pressure of the second vacuum chamber 2 is 5 mbar, the radio frequency ion guide device 22 is arranged therein to focus the ions carried in the gas flow and keep the ions moving in axial direction. The third vacuum chamber 3 is internally provided with a linear ion trap mass analyzer 32 for performing mass analysis.

The first vacuum chamber 1 and the second vacuum chamber 2 are both equipped with roughing pumps, such as scroll pumps. The scroll pump SP1 connected to the first vacuum chamber 1 may meet the pressure requirement of the first vacuum chamber 1 when working at a pumping speed of 2 L/min, so the ultimate pumping speed to be provided by the scroll pump is relatively small and the size of the pump does not need to be very great. The scroll pump SP2 connected to the second vacuum chamber 2 may meet the pressure requirement of the second vacuum chamber 2 when working at a pumping speed of 10 L/min, and the size of the scroll pump SP2 with this pumping speed neither will be too great. Overall, the pump system is relatively low in complexity and relatively small in size.

According to setting of the above parameter, gas flow rate data of the system of the mass spectrometer may be calculated.

$Q_2=Q_{TMP}=0.001$ mbar×4800 L/min≈5 mbar·L/min $Q_{SP2}=5$ mbar×10 L/min=50 mbar·L/min $Q_1=Q_2+Q_{SP2}=55$ mbar·L/min $Q_{SP1}=55$ mbar×2 L/min=110 mbar·L/min $Q_0=Q_1+Q_{SP1}=165$ mbar·L/min The inlet gas flow rate $Q_V$ of the system=$Q_0$/atm=0.165 L/min According to the above calculation, the mass spectrometer may reach the inlet gas flow rate of the system of 165 mL/min using the above design. The inlet gas flow of the system is increased to three times compared with the value (55 mL/min) of a two-stage vacuum system using basically the same pump model. In addition, the inner diameter of the capillary used for sample introduction is relatively large as well, resulting in not only a relatively-low loss of internal transmission ions, but also a relatively-low probability of clogging.

In some embodiments, the ion focusing device 11 may further be arranged in the first vacuum chamber 1, which may be, for example, an electrostatic focusing device or an aerodynamic focusing device. The ion focusing device 11 or the aerodynamic focusing device may keep ions in the center of the gas flow, such that even if air expands or deflects during flowing of transmission in the axial direction, the ions may still be stably transmitted into the second vacuum chamber 2 and the third vacuum chamber 3 for mass analysis by the mass analyzer 32.

Even if the gas flow entering the second vacuum chamber 2 drops to a specified ratio or even a lower ratio of inlet gas flow rate of the system, the ion transmission efficiency may still be higher than that in FIG. 4 due to a focusing effect of the ion focusing apparatus 22, thus effectively improving the sensitivity of the system. In the above way, the sensitivity and miniaturization of the system can be effectively balanced.

Those of ordinary skill in the art may understand that in each embodiment described above, many technical details have been put forward in order to make readers better understand the present application. However, even without these technical details and various changes and modifications based on the above embodiments, technical solutions to be protected as required in the claims of the present application may be basically realized. Therefore, in a practical application, various changes may be made to the above embodiments in form and detail without departing from the principle and scope of the present invention.

What is claimed is:

1. A mass spectrometer, comprising:

a first vacuum chamber, which is provided with an atmospheric pressure interface communicating with an external atmospheric pressure environment and is connected to a first vacuum pump, the range of working pressure P1 of the first vacuum chamber being P1>30 mbar;

a second vacuum chamber, which is connected to the first vacuum chamber by means of a vacuum interface to receive the analyte from the first vacuum chamber, and is connected to a second vacuum pump, the range of working pressure P2 of the second vacuum chamber being 0.5 mbar≤P2≤30 mbar;

a third vacuum chamber, which is connected to the second vacuum chamber by means of a vacuum interface to receive the analyte from the second vacuum chamber, and is connected to a third vacuum pump, the first vacuum pump or the second vacuum pump being used as a forepump of the third vacuum pump, and an ion source, located in the external atmospheric pressure environment, wherein the ion source is communicating with the first vacuum chamber through the atmospheric pressure interface.

2. The mass spectrometer according to claim 1, wherein both the first vacuum pump and the second vacuum pump are roughing pumps.

3. The mass spectrometer according to claim 2, wherein the range of a pumping speed S1 of the first vacuum pump is one selected from the following ranges: S1≤1 L/min or S1≤2 L/min or S1≤3 L/min or S1≤4 L/min or S1≤5 L/min.

4. The mass spectrometer according to claim 2, wherein the range of a pumping speed S2 of the second vacuum pump is one selected from the following ranges: S2≤10 L/min or S2≤20 L/min or S2≤30 L/min or S2≤40 L/or S2≤50 L/min.

5. The mass spectrometer according to claim 1, wherein an electrostatic focusing unit or an aerodynamic focusing unit is arranged in the first vacuum chamber; and it is used for focusing ions in the gas flow entering the first vacuum chamber from the atmospheric pressure interface, into a path for transmission to the second vacuum chamber.

6. The mass spectrometer according to claim 1, wherein a radio frequency ion guide apparatus is arranged in the second vacuum chamber, and is used for guiding ions to pass through the second vacuum chamber and then enter the third vacuum chamber.

7. The mass spectrometer according to claim 1, wherein the atmospheric pressure interface is a capillary, a cylindrical aperture or a conical aperture.

8. The mass spectrometer according to claim 1, wherein the vacuum interface is a cylindrical aperture, a conical aperture or a combination thereof.

9. The mass spectrometer according to claim 1, wherein the third vacuum pump is a turbo molecular pump, and a mass analyzer is arranged in the third vacuum chamber.

10. The mass spectrometer according to claim 9, wherein the mass analyzer is a quadrupole mass analyzer or an ion trap mass analyzer.

* * * * *